United States Patent [19]

Gunn et al.

[11] Patent Number: 4,799,600

[45] Date of Patent: Jan. 24, 1989

[54] BAGGAGE AND CARGO CONTAINER

[75] Inventors: Erwin T. Gunn, Seattle; John M. Bigler, Redmond; Patrick J. Hamill, Kent, all of Wash.

[73] Assignee: The Boeing Company, Seattle, Wash.

[21] Appl. No.: 39,701

[22] Filed: Apr. 20, 1987

[51] Int. Cl.[4] ..... B65D 87/14

[52] U.S. Cl. ..... 220/1.5; 220/83; 220/72

[58] Field of Search ..... 220/1.5, 8, 72, 83, 220/89 A; 190/103

[56] References Cited

U.S. PATENT DOCUMENTS

| | | | |
|---|---|---|---|
| 1,045,390 | 11/1912 | Goldsmith . | |
| 1,712,448 | 5/1929 | Eckhardt | 190/103 |
| 2,139,143 | 12/1938 | Wiswell | 220/83 |
| 2,442,459 | 6/1948 | Fowler | 244/114 |
| 3,280,871 | 10/1966 | Taylor | 150/52 |
| 3,294,034 | 12/1966 | Bodenheimer et al. | 105/366 |
| 3,502,205 | 3/1970 | Milton | 206/46 |
| 3,651,974 | 3/1972 | Barry et al. | 220/1.5 |
| 3,692,203 | 9/1972 | Byrd et al. | 220/1.5 |
| 3,907,148 | 9/1975 | Meller et al. | 220/1.5 |
| 3,915,327 | 10/1975 | Lovich et al. | 220/1.5 |
| 4,046,186 | 9/1977 | Nordstrom | 220/1.5 X |
| 4,046,277 | 9/1977 | Morrison | 220/1.5 |

*Primary Examiner*—Steven M. Pollard

*Attorney, Agent, or Firm*—Christensen, O'Connor, Johnson & Kindness

[57] ABSTRACT

A baggage and cargo container 10 including a floor 22, a plurality of side walls 18, 26 having reinforcement ribs 40 for resisting compressive loads and an unreinforced top portion 36, 38 that will collapse when subjected to a load of at least 1,000 pounds, a top 28, 30, and an opening 42 formed in one of the side walls 18 and extending into the top 30. The opening 42 is enclosed by a two-part cover 46 having a rigid top cover 48 and a flexible front cover 50.

22 Claims, 3 Drawing Sheets

BAGGAGE AND CARGO CONTAINER

FIELD OF THE INVENTION

The present invention relates to baggage and cargo containers and, more particularly, to containers for use in the lower lobe cargo compartments of standard body aircraft.

BACKGROUND OF THE INVENTION

Baggage and cargo containers are used to facilitate the loading and unloading of baggage and cargo in large passenger aircraft. Typically, the containers are stored in the aircraft's lower lobe cargo holds, i.e., cargo holds located beneath the main floor of the passenger cabin. In addition to the storage of luggage and cargo, the containers can be used to provide greater passenger safety in the event the aircraft is subjected to severe vertical loads, such as occur during a crash condition. This is accomplished by designing the containers to collapse under the vertical compressive loads exerted by the passenger deck floor beams and the cargo hold floor when a severe vertical load distorts the aircraft. This prevents crushing of the main deck floor beams when the beams deflect under the loads from the passenger deck during a crash condition.

One disadvantage of present containers is that their rigidity transfers the vertical loads resulting from a crash condition directly from the floor of the cargo deck to the passenger deck floor beams. This can cause structural deformation of the deflected main deck floor beams as they impinge on the rigid containers and consequent weakening of the floor of the passenger cabin, resulting in serious or fatal injuries to the passengers. Another disadvantage of present containers is that they are often difficult to unload because the openings are inadequately sized and/or shaped for the easy insertion and removal of baggage and cargo.

In addition to having flexibility to accommodate floor beam deflection, and having large openings to facilitate loading and unloading of baggage and cargo, a container must remain strong enough to retain its shape when fully loaded so as to not interfere with the aircraft cargo door frame or the cargo hold interior. Furthermore, the container must maintain its shape while standing fully loaded for several days. Finally, the container must have sufficient traction to remain on an inclined belt loader in conditions of snow and ice.

SUMMARY OF THE INVENTION

In accordance with the present invention, an improved baggage and cargo container for use in aircraft lower lobe cargo compartments is provided. The improved baggage container includes a bottom, a plurality of rigid sidewalls, and a top. The improvement comprises a plurality of sidewalls, each having a region that horizontally circumscribes the container that is weaker than the remainder of the sidewalls and thus collapsible while the remainder of the sidewalls are not collapsible when the container is subjected to a predetermined vertical compressive load. Preferably, the weaker region is located in the upper portion of the plurality of sidewalls.

In accordance with still other aspects of this invention, the predetermined compressive load that will cause the sidewalls to collapse is at least 1,000 pounds.

In accordance with still further aspects of this invention, the container bottom comprises a rigid floor for bearing loads, and the plurality of sidewalls are integral with the rigid floor. Further, the sidewalls have a reinforced portion for resisting compressive loads and an unreinforced portion that is weaker than the reinforced portion and, thus, will collapse prior to the collapse of the reinforced portion when a predetermined vertical compressive load is applied to the container. Also, one of the sidewalls has an opening for inserting and removing baggage and cargo. Preferably, the unreinforced portion is located in the upper portion of the plurality of sidewalls.

In accordance with still yet further aspects of this invention, the opening is reinforced to resist compressive loads subjected thereon.

In accordance with still further aspects of this invention, the top is integral with the upper portion of the plurality of sidewalls and the opening extends into a portion of the top.

In accordance with still further aspects of this invention, the opening is enclosed by a cover that comprises a rigid door sized to cover the portion of the opening extending into the top and a flexible door that is attached to the rigid door and sized to cover the opening in one of the plurality of sidewalls.

As will be readily appreciated from the foregoing description, the invention provides a container having an unreinforced sidewall portion that collapses when subjected to a predetermined vertical compressive load. A large opening located in one of the plurality of sidewalls and extending into the top provides easy access to facilitate loading and unloading of baggage and cargo. In addition, the two-part cover gives the baggage and/or cargo handler the option of opening only the flexible cover or opening both the flexible cover and the top cover to provide access to the container.

BRIEF DESCRIPTION OF THE DRAWINGS

The foregoing and other advantages and features of this invention will become more readily appreciated as the same becomes better understood by reference to the following detailed description when taken in conjunction with the accompanying drawings wherein.

DESCRIPTION OF THE PREFERRED EMBODIMENT

Figure 1:
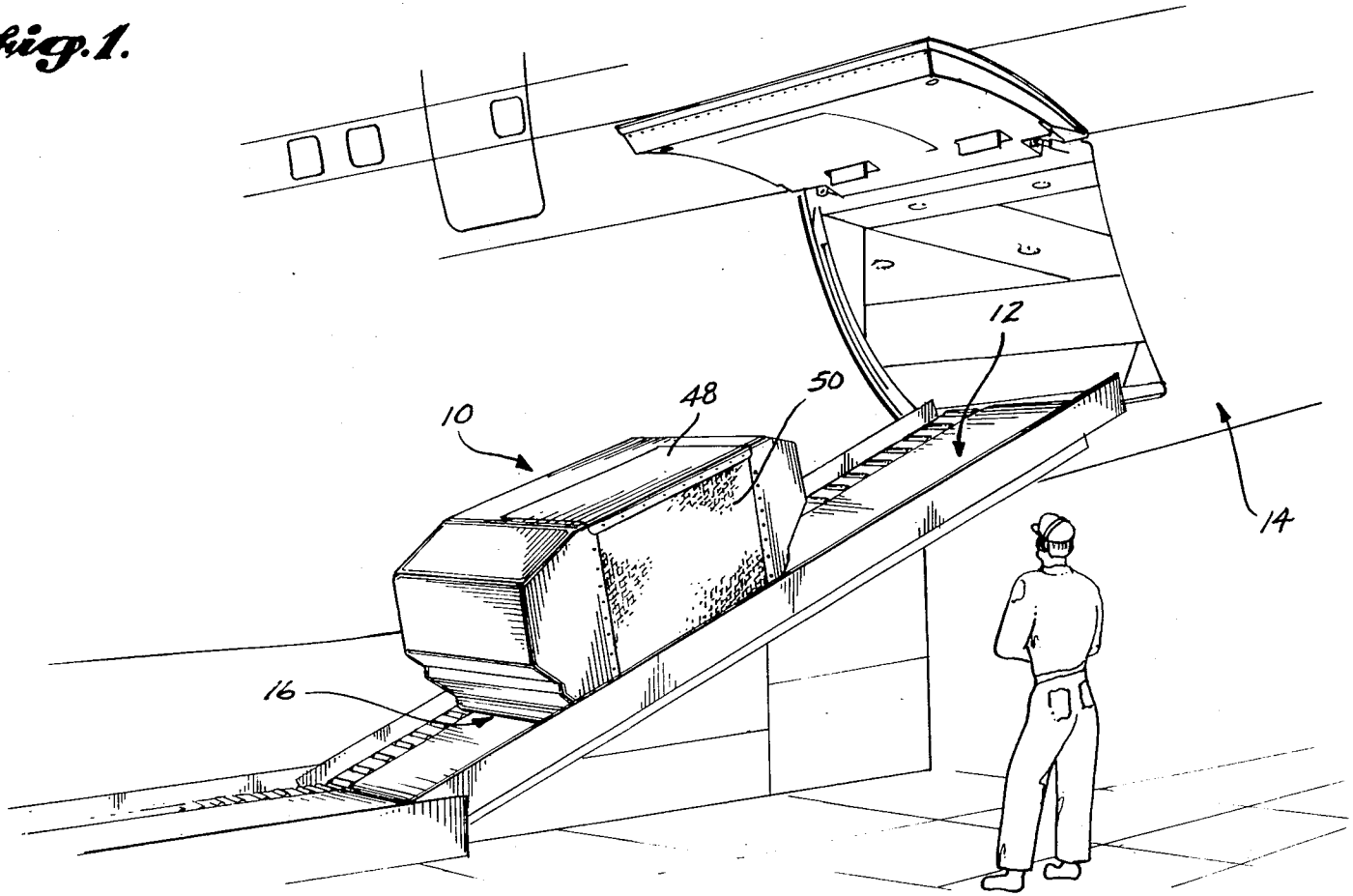
FIG. 1 is an isometric view of a preferred embodiment of the invention.

FIG. 1 is an isometric view of a baggage and cargo container 10 formed in accordance with the present invention. The container 10 is shown being transported on an inclined belt ramp 12 either into or away from a commercial passenger aircraft 14. The container may also be loaded or unloaded with a conventional platform container loader. The bottom surface 16 of the container 10 preferably is provided with a rough finish to thereby increase friction between the bottom surface 16 and the inclined belt ramp 12, especially during wet or icy weather. Another method for increasing friction would be to attach abrasive skids to the bottom surface 16.

The container 10 is shaped and dimensioned to be used with an automated cargo handling system on large commercial aircraft such as the Boeing 727 or 757 aircraft. As is more clearly shown in FIG. 2, the container 10 has a pair of oppositely-disposed, otuwardly projecting sides 18. Each of the sides 18 has an outwardly projecting inclined bottom 20 that is integral with the floor 22 of the container 10. The inclined bottoms 20 preferably have a stepped portion 24 that rises vertically for a short distance from the floor 22 to give added strength and prevent bulging of the inclined bottom 20 when the container 10 is heavily loaded. Each of the sides 20 also includes a substantially vertical end wall 26 that is integral with the inclined bottom 20 and an inwardly projecting side top 28 that is integral with the end wall 26. A central top 30 integral with the facing edges of the side tops 28 overlies the bottom 22. Integral front walls 32 extend between the inclined bottoms 20 and the inwardly projecting side tops 28 of the sides 18. Finally, an integral back wall 34 extends between the floor 22 and the inclined bottom 20, and the center top 30 and the side tops 28.

Although the container 10 is preferably constructed of integral panels, e.g., walls, floors, bottoms and tops, it is to be understood that the container can be constructed of separate panels, attached together if desired. Ideally, the container 10 is constructed of plastics and formed in a rotational mold. Processing of plastic in a rotational mold involves spinning of a form about 3 axes in an oven to evenly distribute the plastic, which sticks to the hot skin of the form. A uniform wall thickness of 0.3 inches has proven to be suitable when using an ultra high density polyethylene plastic, which is preferred for rotational molding.

Figure 4:
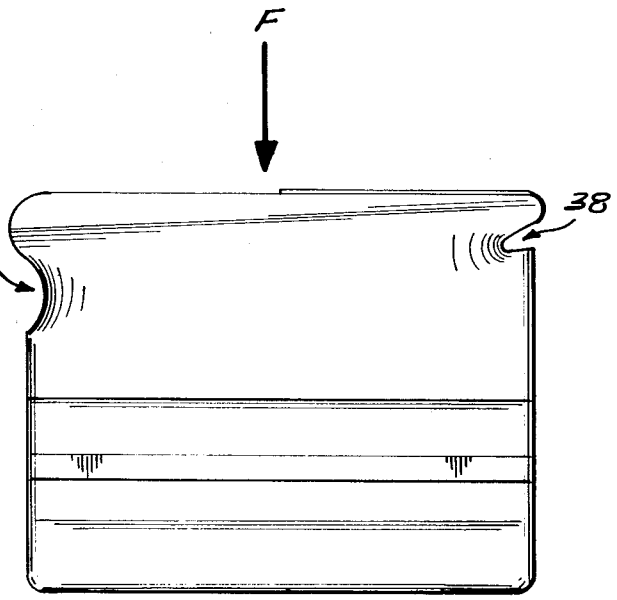

The use of plastics facilitates a lighter weight and enhances the unique crushable feature of the container 10. As is illustrated in FIG. 4, under a vertical compressive load the top portion 36 of the back wall 34 and the top portion 38 of the front wall 32, in conjunction with the side tops 28 and the center top 30, are designed to collapse. Ideally, collapsing should occur when the vertical compressive load is 1,000 pounds or greater. This collapsible feature permits the container 10 to absorb a multiple G force exerted on the main floor beams as a result of an impact of the aircraft on the ground. The absorbing of the load through the crushable top prevents the container 10 from deflecting the passenger deck floor beams upward into the passenger cabin and possibly causing injuries or fatalities to passengers. In addition, the collapsing of the container top prevents the container 10 from crushing the main deck floor beams. Structurally damaged floor beams are unable to restrain passengers against subsequent vertical and forward loads. This lack of restraint could also result in injury or fatalities to passengers.

Figure 2:
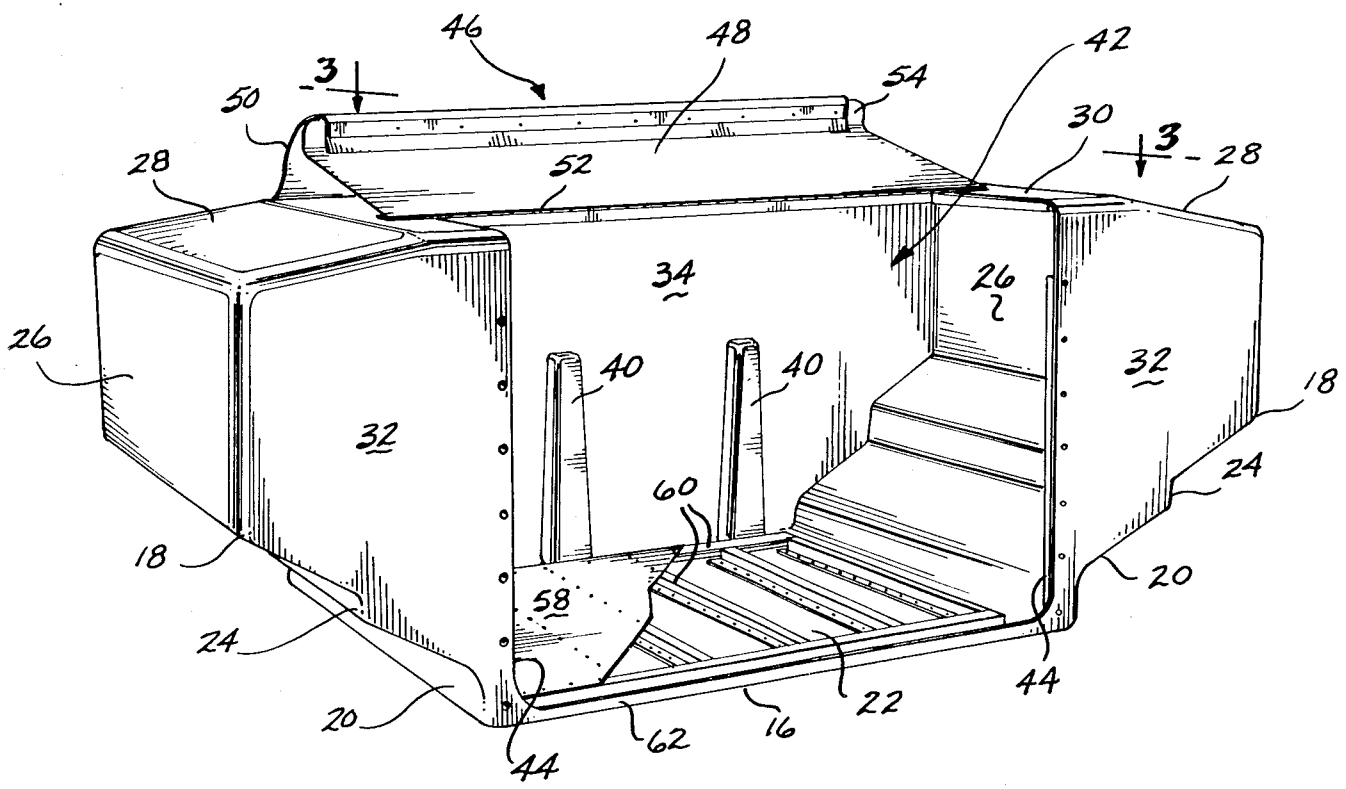
FIG. 2 is an enlarged, isometric view, partially in cross section of the embodiment of the invention illustrated in FIG. 1.
Figure 3:
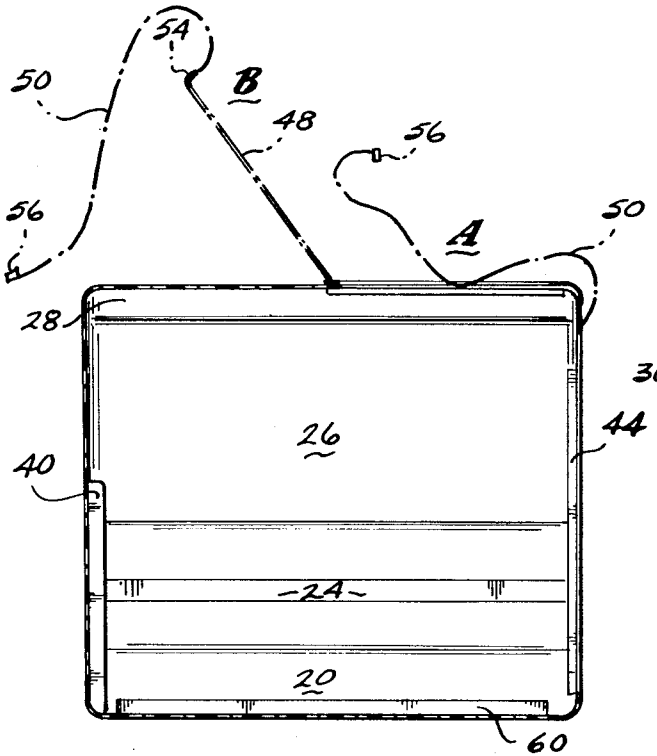
FIG. 3 is a cross-sectional view taken along lines 3—3 of the preferred embodiment illustrated in FIG. 2; and, FIG. 4 is a side elevational view showing the container collapsing under a vertical compressive load.

The top portions 36, 38 and the side tops 28 and the center top 30 collapse under the predetermined vertical compressive load due to the absence of structural reinforcements in these areas. As is shown in FIGS. 2 and 3, the back wall 34 has preformed ribs 40 extending from the floor 22 up to the top portion 36. The ribs 40 give structural reinforcement to the lower portion of the back wall 34 as well as aid in removal of the container 10 from the form when it is constructed.

The front wall 32 has an opening 42 for loading baggage and cargo into and removing baggage and cargo from the container 10. The opening 42 includes a rectangular section that extends into the center top 30 to provide greater access for baggage and cargo handlers. Reinforcing members 44 are attached to the inside edges 45 of the opening 42. The reinforcing member extends from the floor 22 up to the bottom of the unreinforced top portion 38 where they terminate. The reinforcing members 44 give structural reinforcement and protection to the area around the inside edges 45 of the opening 42 that are continually impacted during the insertion and removal of baggage and cargo. The unreinforced top portion 38 is thus free to collapse down to the top of the reinforcing members 44.

The opening 42 is provided with a cover 46 to protect the contents of the container 10 from water, dirt, and fumes, and to prevent the contents from accidentally spilling out. Preferably, the cover 46 is constructed in two parts - a rigid aluminum top cover 48 and a flexible front cover 50 constructed either of plastic, cloth, or canvas. The top cover 48 ideally is attached to the center top 30 by a piano hinge 52 located along the innermost edge of the portion of the opening 42 that extends into the center top 30. The top cover 48 is wide enough to overlap both sides of the opening 42 in the center top 30, and has a curved flange portion 54 that depends over the front wall 32 when the cover is in a closed position. The flexible cover 50 is attached to the curved flange portion 54 and hangs down flush with the inside edges 45 of the opening 42. The flexible cover 50 has a reinforcing bar 56 attached at the bottom edge for latching to the container 10. While magnets, clips, or other suitable latch means may be used, a bayonet latch on each side of the flexible cover 50 and insertable into an opening in the reinforcing members 44 has worked well to maintain the flexible cover 50 in a taut, closed position. As shown in FIG. 3, the handler has the option of only opening the flexible cover 50, denoted as position A, or opening the flexible cover 50 and the top cover 48 simultaneously, shown as position B.

Although the floor 22 may be used without reinforcement, the container 10 is shown with a raised, finished floor 58, in this case constructed of aluminum alloy sheet metal, although other materials may be used without departing from the spirit and scope of the present invention. The finished floor 58 rests atop lateral and longitudinal floor supports 60. In addition to reinforcing the floor, the raised finished floor 58 is elevated to be even with the bottom edge 62 of the opening 42 to permit baggage and/or cargo to be slid into and out of the container 10 without obstruction from the bottom edge 62.

As is evident from the foregoing, the present invention provides a container that has a crushable top portion for absorbing compressive vertical loads to thereby prevent damage to the passenger deck floor beams and injury or fatalities to passengers. Unreinforced top portions of the container sidewalls will collapse under a predetermined load, while the reinforced lower portions maintain the shape of the baggage container. The large opening and two-part cover facilitate loading and unloading of the container and protect the baggage and cargo from the outside elements. Baggage and cargo handling is also facilitated by the raised finished floor that also reinforces the floor area of the container.

While a preferred embodiment of the invention has been illustrated and described, it will be appreciated that various changes can be made therein without departing from the spirit and scope of the invention. For example, the flexible cover may be pivotably attached to the flange portion of the top cover to facilitate only opening the flexible core. Consequently, the invention can be practiced otherwise than as specifically described herein.

The embodiments of the invention in which an exclusive property or privilege is claimed are defined as follows:

1. In a baggage and cargo container for storing baggage and cargo, the container having a bottom, a plurality of rigid sidewalls, and a top, the improvement comprising a region of said plurality of rigid sidewalls that horizontally circumscribes the container being weaker than the remainder of said sidewalls and, thus, collapsible while the remainder of said sidewalls are not collapsible when the container is subjected to a predetermined vertical compressive load.

2. The improvement claimed in claim 1, wherein said weaker region is located in the upper portion of said plurality of sidewalls.

3. The improvement claimed in claim 1, wherein said predetermined compressive load is at least 1,000 pounds.

4. A container for storing baggage and cargo, comprising:

(a) a rigid floor for bearing loads;

(b) a plurality of rigid sidewalls integral with said rigid floor, said sidewalls having a reinforced portion for resisting compressive loads and an unreinforced portion that is weaker than said reinforced portion and, thus, will collapse prior to the collapse of said reinforced portion when a predetermined vertical compressive load is applied to said container; and, (c) an opening for inserting and removing baggage and cargo.

5. The container of claim 4, wherein said unreinforced portion is located in the upper portion of said plurality of sidewalls.

6. The container of claim 5, wherein said opening is formed in one of said plurality of sidewalls.

7. The container of claim 6, wherein the lower portion of said opening is reinforced to resist compressive loads subjected thereon.

8. The container of claim 7, further comprising a top integral with said upper portion of said plurality of sidewalls.

9. The container of claim 8, wherein said opening in one of said plurality of sidewalls includes a portion extending into said top.

10. The container of claim 9, further comprising a cover for said opening.

11. The container of claim 10, wherein said cover comprises a rigid door sized to cover the portion of said opening extending into said top, and a flexible door attached to said rigid door for covering said opening in one of said plurality of sidewalls.

12. The container of claim 4, wherein said predetermined load is at least 1,000 pounds.

13. A container for storing and transporting baggage and cargo, comprising:

(a) a floor for bearing loads, said floor having reinforcing members to impart rigidity to said floor;

(b) a pair of rigid oppositely-disposed, outwardly projecting sides, each of said sides comprising an outwardly projecting inclined bottom attached to said floor, a vertical wall attached to said inclined bottom, and an inwardly projecting side top attached to said vertical wall;

(c) a front wall attached to said floor and said oppositely-disposed sides, said front wall including an opening for inserting and removing luggage, and reinforcing means formed around a lower portion of said opening;

(d) a cover for said opening;

(e) a back wall attached to said floor and said oppositely-disposed sides, said back wall having a reinforced lower portion and an unreinforced upper portion; and (f) a center top attached to said side tops, said back wall, and said front wall, said center top having no reinforcing, such that when the container is subjected to a vertical compressive load, the center top, the side tops, and the upper portions of said front and back walls will deform and collapse to absorb said load.

14. The container of claim 13, wherein said cover includes a flexible door for covering said front wall opening.

15. The container of claim 14, wherein said center top also includes an opening, said center top opening aligned with the opening in said front wall.

16. The container of claim 15, wherein said cover also includes a rigid door for covering said center top opening.

17. The container of claim 16, wherein said flexible door is attached to said rigid door, whereby said rigid door covers said center top opening and said flexible door projects downward from said rigid door and covers said front wall opening.

18. The container of claim 13, wherein each of said side tops is inwardly inclined from the vertical wall to said center top.

19. The container of claim 18, wherein said cover includes a flexible door for covering said front wall covering.

20. The container of claim 19, wherein said center top also includes an opening, said center top opening aligned with the opening in said front wall.

21. The container of claim 20, wherein said cover also includes a rigid door for covering said center top opening.

22. The container of claim 21, wherein said flexible door is attached to said rigid door, whereby said rigid door covers the opening in said center top and said flexible door projects downward from said rigid door to cover said opening formed in said front wall.

* * * * *